US009188958B2

(12) United States Patent
Hessler et al.

(10) Patent No.: US 9,188,958 B2
(45) Date of Patent: Nov. 17, 2015

(54) ILLUMINATED BALANCE SPRING

(71) Applicant: THE SWATCH GROUP RESEARCH AND DEVELOPMENT LTD, Marin (CH)

(72) Inventors: Thierry Hessler, St-Aubin (CH); Francois Gueissaz, Wavre (CH); Michel Willemin, Preles (CH); Jean-Claude Martin, Montmollin (CH)

(73) Assignee: The Swatch Group Research and Development Ltd, Marin (CH)

( * ) Notice: Subject to any disclaimer, the term of this patent is extended or adjusted under 35 U.S.C. 154(b) by 0 days.

(21) Appl. No.: 14/430,646

(22) PCT Filed: Sep. 20, 2013

(86) PCT No.: PCT/EP2013/069560
§ 371 (c)(1),
(2) Date: Mar. 24, 2015

(87) PCT Pub. No.: WO2014/053336
PCT Pub. Date: Apr. 10, 2014

(65) Prior Publication Data

US 2015/0261187 A1 Sep. 17, 2015

(30) Foreign Application Priority Data

Oct. 4, 2012 (EP) ..... 12187216

(51) Int. Cl.
*G04B 17/06* (2006.01)

(52) U.S. Cl.
CPC ..... *G04B 17/06* (2013.01); *G04B 17/066* (2013.01)

(58) Field of Classification Search
CPC ..... G04B 19/30; G04B 19/06; G04B 19/063; G04B 19/066
See application file for complete search history.

(56) References Cited

U.S. PATENT DOCUMENTS

| | | | | |
|---|---|---|---|---|
| 4,115,994 | A * | 9/1978 | Tomlinson | 368/241 |
| 5,291,851 | A * | 3/1994 | Muramatsu | 116/286 |
| 8,169,858 | B2 * | 5/2012 | Klopfenstein et al. | 368/67 |
| 2006/0067168 | A1 * | 3/2006 | Winkler et al. | 368/67 |
| 2008/0008050 | A1 | 1/2008 | Bourgeois | |
| 2009/0016173 | A1 | 1/2009 | Hessler et al. | |
| 2009/0109801 | A1 * | 4/2009 | Winkler | 368/67 |

(Continued)

FOREIGN PATENT DOCUMENTS

| | | | |
|---|---|---|---|
| CH | 699780 | A2 | 4/2010 |
| EP | 1605182 | A1 | 12/2005 |

(Continued)

OTHER PUBLICATIONS

International Search Report issued Oct. 24, 2013 in PCT/EP2013/069560 filed Sep. 20, 2013.

*Primary Examiner* — Sean Kayes
(74) *Attorney, Agent, or Firm* — Oblon, McClelland, Maier & Neustadt, L.L.P.

(57) ABSTRACT

A watch or timepiece regulating member includes a balance, a balance-cock, at least one light energy source, and at least one balance spring attached between the balance and the balance-cock. The balance spring is made of quartz or of glass or of ceramic or is partially transparent to visible and/or ultraviolet wavelengths or made of an at least partially amorphous material and transmits and diffuses light emitted by the light energy source.

18 Claims, 2 Drawing Sheets

(56) References Cited

U.S. PATENT DOCUMENTS

| | | | | |
|---|---|---|---|---|
| 2009/0185458 | A1* | 7/2009 | Harley, Jr. | 368/227 |
| 2010/0054090 | A1 | 3/2010 | Orny et al. | |
| 2012/0008468 | A1 | 1/2012 | Bossart et al. | |
| 2013/0135974 | A1* | 5/2013 | Niedermann et al. | 368/175 |

FOREIGN PATENT DOCUMENTS

| | | | |
|---|---|---|---|
| EP | 1791039 | A1 | 5/2007 |
| EP | 2407831 | A1 | 1/2012 |
| FR | 2957688 | A1 | 9/2011 |
| WO | 2008/080570 | A2 | 7/2008 |

* cited by examiner

ILLUMINATED BALANCE SPRING

CROSS-REFERENCE TO RELATED APPLICATIONS

This is a National phase application in the United States of International patent application PCT/EP2013/069560 filed Sep. 20, 2013 which claims priority on European patent application No. 12187216.2 filed Oct. 4, 2012. The entire disclosures of the above patent applications are hereby incorporated by reference.

FIELD OF THE INVENTION

The invention concerns a watch or timepiece regulating member including a balance, a balance-cock, at least one light energy source, and at least one balance spring attached between said balance and said balance-cock, said at least one balance spring being arranged to transmit and diffuse light.

The invention also concerns a mechanical timepiece movement including at least one such regulating member.

The invention also concerns a timepiece including one such mechanical movement and/or at least one such regulating member.

The invention concerns the field of mechanical horology.

BACKGROUND OF THE INVENTION

Enhancing the prestige of a mechanical timepiece mechanism, more specifically a watch, with regard to clients, is often achieved by revealing its components, and skeleton movements are appreciated by clients who can view the important functions of the complex object in their possession. The presentation of the tourbillon in high end timepieces, or of the balance spring in more conventional timepieces, which form the visible heart of a movement, are particularly valued. The best display possible therefore constitutes an important asset and a decision criteria for the purchaser. Thus it is useful to render the balance spring as visible as possible, and at any time of the day or night, and in particular by making it luminous.

Users often feel the need to verify the proper operation of their watch or of their timepiece, which can be achieved by listening to the ticking of the mechanism. However, this method is not possible in a noisy environment, or for the hard of hearing.

CH Patent Application No 699780A2 in the name of RICHEMONT discloses a self-compensating silicon watch spring, with a coating covering one portion of the outer surface of the spring.

EP Patent Application No 1605182A1 in the name of CSEM discloses a temperature compensated sprung balance with a quartz spring, and particularly a quartz substrate, the cut of which is chosen to thermally compensate the deviations of the balance spring and those of the balance.

EP Patent Application No 2407831A1 in the name of ROLEX discloses a silicon, diamond or quartz balance spring which includes pierced holes distributed over the length thereof and alternating with bridges.

EP Patent Application No 1791039A1 in the name of SWATCH GROUP RESEARCH AND DEVELOPMENT discloses a balance spring made of athermal glass from photo-structurable glass by UV radiation.

WO Patent Application No 2008/080570A2 in the name of COMPLITIME discloses a balance spring and a balance made from the same material, particularly diamond, quartz or ceramic.

SUMMARY OF THE INVENTION

The invention proposes to provide a compact, low energy consumption solution to the problem of visually displaying the balance spring of a mechanical watch, or, more generally, of a mechanical timepiece.

In particular, it displays and enhances the balance spring as the heart of the movement, and uses an analogy between the cyclical contraction and expansion movements of the balance spring and those of the human heart.

To this end, the invention concerns a watch or timepiece regulating member including a balance, a balance-cock, at least one light energy source, and at least one balance spring attached between said balance and said balance-cock, said at least one balance spring being arranged to transmit and diffuse light and characterized in that said at least one balance spring transmits and diffuses the light emitted by said at least one light energy source of said regulating member.

According to a characteristic of the invention, said at least one balance spring is made of quartz or of glass or of ceramic, or is partially transparent to visible and/or ultraviolet wavelengths, or made of an at least partially amorphous material.

The invention further concerns a mechanical timepiece movement characterized in that it includes at least one watch or timepiece regulating member including a balance, a balance-cock and at least one balance spring attached between said balance and said balance-cock, characterized in that said at least one balance spring transmits and diffuses the light emitted by at least one light energy source which is moved out of said regulating member and into said movement, in which case it is connected by at least one light guide or one optical fibre to a light relay which is located in said regulating member in proximity to said balance spring.

The invention also concerns a timepiece including one such mechanical movement and/or a mechanical movement including at least one such regulating member.

BRIEF DESCRIPTION OF THE DRAWINGS

Other features and advantages of the invention will appear upon reading the following detailed description, with reference to the annexed drawings, in which:

FIG. 8 shows a partial plan view of two light sources disposed underneath the balance spring, one in proximity to the collet, and the other in proximity to the stud, in two positions of the balance spring, at maximum contraction in FIG. 8A and at maximum elongation in FIG. 8B.

DETAILED DESCRIPTION OF PREFERRED EMBODIMENTS

Figure 1:
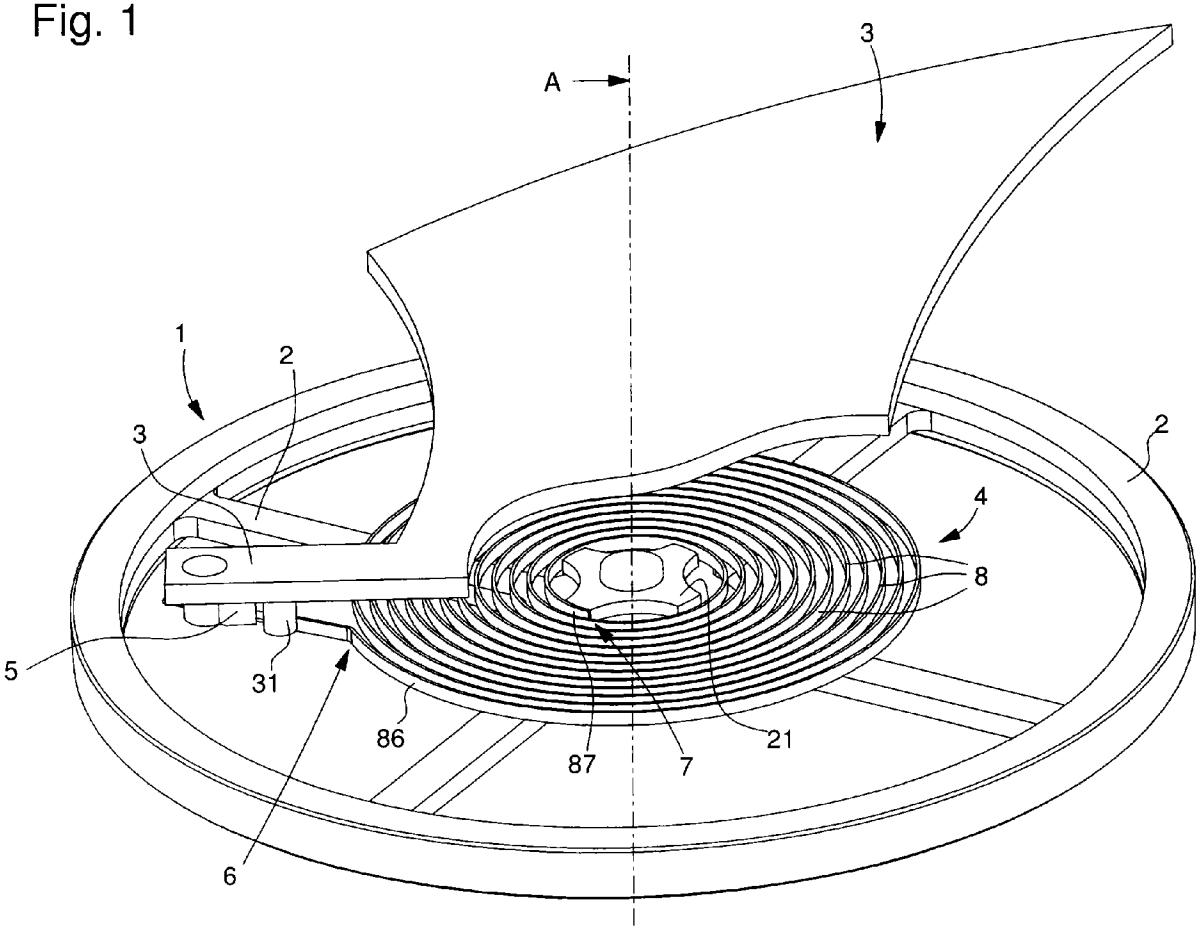
FIG. 1 shows a schematic, partial and perspective view of a watch regulating member, including a balance, a balance spring and a balance-cock, and a light source in proximity to one end of the balance spring.

The invention concerns the field of mechanical horology.

The invention provides a novel visual display of the balance spring of a mechanical watch, or, more generally, of a mechanical timepiece. It displays and enhances the balance spring as the heart of the movement, and uses an analogy between the cyclical contraction and extension movements of the balance spring and those of the human heart.

More particularly, the balance spring is rendered luminous by employing a particular material permitting light diffusion. In particular, single crystal quartz and glass may be employed as light guides. Light, from an active or passive light source, injected into one portion of the balance spring, exits in a distributed manner along the entire length of the balance spring, or over one portion thereof, which enables the spring to be seen in the dark. The balance spring conveys and diffuses this light. Injection of light may be performed more easily at one of the ends of the balance spring, and in particular at the outer end thereof, by a light source such as a light emitting diode, or a component coated with a passive phosphorescent layer; these light sources are non-limiting examples.

If necessary, the balance spring is coated with a layer permitting outward diffusion of only one part of the light, while guiding most of the light along the balance spring, this surface layer may also be phosphorescent or fluorescent. The quartz, glass, photo-structurable glass, or similar material of the balance spring, may be developed to include phosphorescence or fluorescence, either in the mass of the material, or by means of implantation. The balance spring according to the invention behaves like an optical fibre, for guiding and diffusing the light.

Thus, the invention concerns a watch or timepiece regulating member including a balance 2, a balance-cock 3, at least one light energy source 5 and at least one balance spring 4 fixed between balance 2 and balance-cock 3. The term "balance-cock" also covers embodiments where a main plate or a bridge carries one of the ends of balance spring 4.

The invention is described, in a non-limiting manner, in the case where a substantially flat balance spring, i.e. whose active coils all extend, during contraction and elongation of balance spring 4, between two parallel planes P1 and P2. Only one inner coil at inner end 7 of balance spring 4 and one outer coil at outer end 6 of balance spring 4 can, in a known manner, extend into the space outside the gap between these two planes, particularly in the case of Breguet overcoils or coils with a Grossmann curve, or others.

According to the invention, said at least one balance spring 4 transmits and diffuses the light emitted by at least one light energy source 5. Preferably, this at least one balance spring 4 is made of quartz or of glass or of ceramic, or is partially transparent to visible and/or ultraviolet wavelengths or made of an at least partially amorphous material.

This light energy source 5 may be a primary source, which stores energy, then returns it through light transmission, or a secondary source, which is called here a "light relay" 50, connected by an optical path formed by a light guide 51 or an optical fibre or similar, to such a primary source 5. Balance spring 4 is then either in contact, or in immediate proximity, either to a primary source, or to a light relay 50, the choice being made according to the space available in the watch and the volume of source 5 or relay 50.

Figures 2, 3, 4, 5, 6, 7, 8A, 8B:
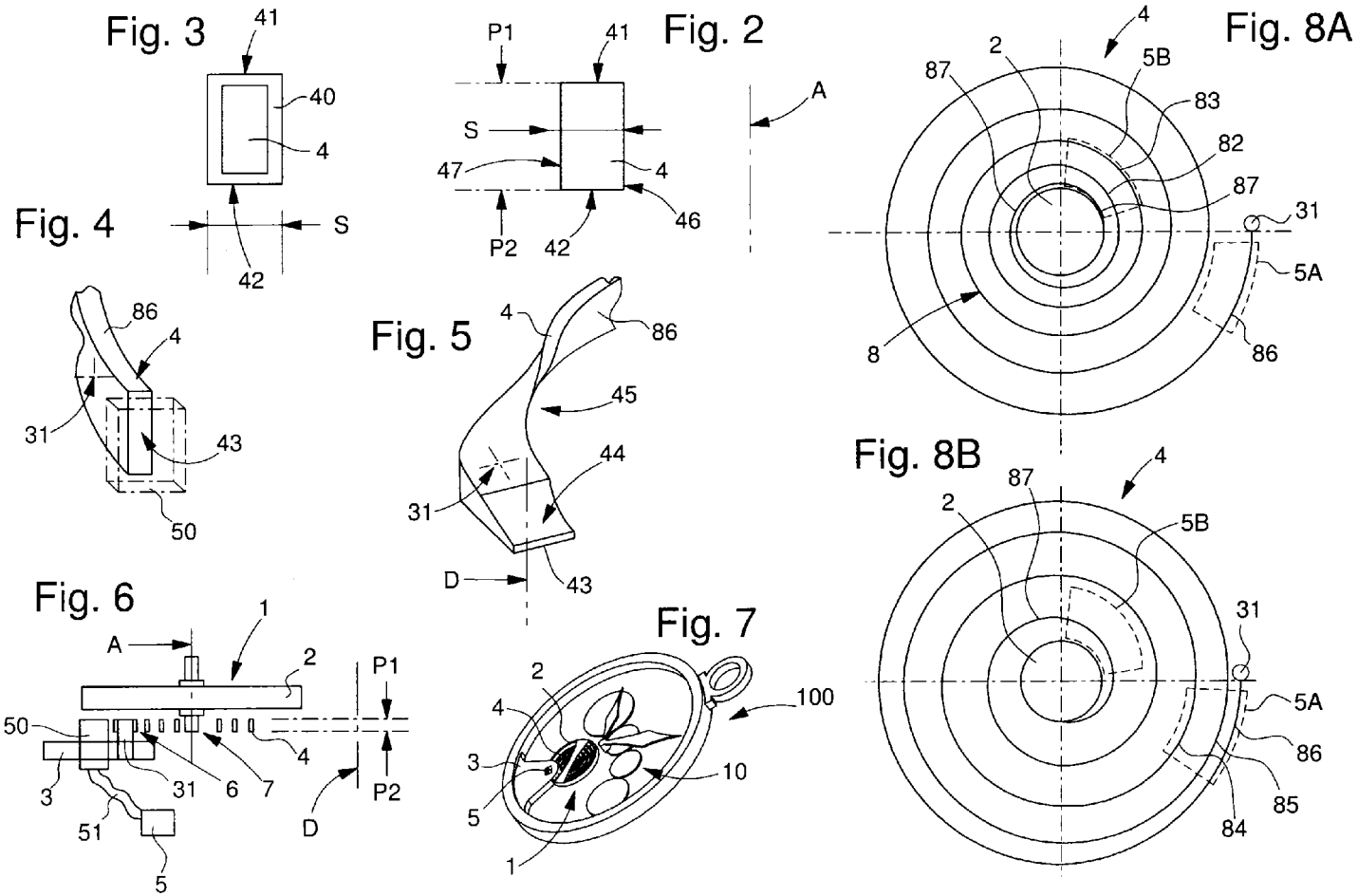
FIG. 2 shows a schematic view of an ordinary cross-section of a balance spring according to a first embodiment wherein the balance spring is of rectangular cross-section, and is bare.
FIG. 3 shows a schematic view of an ordinary cross-section of a balance spring according to a second embodiment wherein the balance spring is of rectangular cross-section, and includes a thin coating on its four surfaces.
FIG. 4 is a schematic, partial and perspective view of the end of a balance spring with an outer coil whose cross-section is parallel to the other coils, this end facing a light relay.
FIG. 5 shows a schematic, partial and perspective view of the end of a balance spring with a twisted outer coil whose cross-section is perpendicular to the other coils, this end comprising a bevel for collecting light from a direction substantially perpendicular to the plane of the bevel.
FIG. 6 shows a schematic, partial, cross-section through the pivot axis of the balance, of the regulating member of FIG. 1, where a light source located inside a watch, and which is not in immediate proximity to the regulating member, is connected by a light guide to a light relay positioned on the balance-cock in proximity to the balance spring.
FIG. 7 is a schematic view of a timepiece with a movement including a regulating member of this type.

In a particular embodiment illustrated by FIGS. 1 and 6, balance-cock 3 carries the light energy source 5 in proximity to an outer end 6 of balance spring 4. It is understood that balance-cock 3 may equally carry a primary source 5 or a light relay 50, the choice again being made according to the space available in the watch and the volume of source 5 or of relay 50.

In another variant not illustrated by the Figures, balance 2 carries the light energy source 5, or a light relay 50 in proximity to an inner end 7 of balance spring 4. This may, in particular, be the case with a one-piece sprung balance assembly made of quartz or of glass or of an at least partially amorphous material, and light can be collected and returned in a convergence area, for example on the balance staff or suchlike.

In yet another variant, light source 5 or relay 50 is in proximity to balance spring 4 above or below the coils of the spring. In a particular version of this variant, several such sources are disposed in proximity to balance spring 4. FIG. 8 therefore shows two light sources 5A and 5B, disposed underneath balance spring 4, one in proximity to collet 21 of balance 2 and the other in proximity to the balance spring stud 31 for attaching balance spring 4 to balance-cock 3. Their arrangement is such that the first source 5A comes into immediate proximity to at least one outer coil 86, and preferably to several consecutive outer coils 84, 85, 86 during the maximum elongation of balance spring 4 and transmits light at the same time to all three of these coils 84, 85, 86, only in this elongated configuration, whereas source 5A only transmits light to one of coils 86 in the contracted configuration of the balance spring. Similarly, a second source 5B comes into immediate proximity to at least one inner coil 87 and preferably to several consecutive inner coils 87, 82, 83, during the maximum contraction of balance spring 4 and transmits light at the same time to all three of these coils 87, 81, 82, only in this contracted configuration, whereas source 5B only transmits light to one of coils 87 in the contracted configuration of the balance spring. It is therefore possible to view the contraction or elongation of balance spring 4, either through the use of different coloured filters on first source 5A and second source 5B, or by colouring outer coil 86 (and neighbouring coils 84 and 85) of balance spring 4 differently from inner coil 87 (and neighbouring coils 81 and 82), either in the mass of the material forming the balance spring, or more simply by means of a surface layer 40 on at least one of the lateral surfaces of balance spring 4.

Due to the particular materials chosen to form balance spring 4, said spring is preferably made in clusters on the same wafer. Each balance spring 4 includes a relatively large point of attachment with large dimensions with respect to the cross-section S of coils 8 of balance spring 4. This point of attachment forms a receiving surface well suited for the light emanating from source 5 or from relay 50, and at the same time provides a good mechanical attachment of balance spring 4 to balance-cock 3.

The at least one balance spring 4 diffuses light over at least one portion of its cross-section. In addition to two outer 43 and inner end surfaces, the balance spring preferably includes upper 41 and lower 42, inner transverse 46 and outer transverse 47 lateral surfaces, which extend along the length of balance spring 4. The light is thus diffused on at least one of the lateral surfaces of the balance spring.

In the frequent case where one of the lateral surfaces is not visible to the user, since it faces a non-transparent component, main plate, or bridge of a movement, this non-visible surface may advantageously include at least one thin surface metallization layer 40 to form a reflective mirror surface and to prevent light diffusion through the non-visible surface concerned. This may be the case, in particular, of lower surface 42 and/or transverse surfaces 46, 47. Local coating of all of the lateral surfaces with such a reflective layer 40 enables light to be channelled into the balance spring over a certain distance without any significant loss. It is therefore possible to choose, over the length of balance spring 4, the areas through which light diffusion is desired, and the orientation of the surfaces concerned, general speaking upper surface 41 and one and/or the other of transverse faces 46, 47.

In a particular embodiment, the at least one balance spring 4 diffuses light over its entire length between said balance-cock 3 and said balance 2.

Preferably, the at least one balance spring 4 is of rectangular cross-section and is formed of a single material, quartz or glass or an at least partially amorphous material, according to FIG. 2.

Preferably, the dimensions of this cross-section of the balance spring are less than 100 micrometres in thickness and 1000 micrometres in height.

In a variant of the invention, the at least one balance spring 4 is of rectangular cross-section and is formed, on the one hand by a first material which is quartz or glass or ceramic, or is partially transparent to visible and/or ultraviolet wavelengths or an at least partially amorphous material, and on the other hand, by a phosphorescent or fluorescent dopant, said dopant being incorporated into the mass of the first material. The material, quartz or glass or suchlike can be doped in the mass (for example by implantation) with a phosphorescent or fluorescent dopant.

In another variant of the invention, the at least one balance spring 4 is of rectangular cross-section and is formed, on the one hand, by a first material which is quartz or glass or ceramic, or is partially transparent to visible and/or ultraviolet wavelengths or an at least partially amorphous material, and on the other hand, by at least a second phosphorescent or fluorescent material applied in a thin layer 40 to at least one of the lateral surfaces of balance spring 4.

In another variant of the invention, the at least one balance spring 4 is of rectangular cross-section and is formed, on the one hand, by a first material which is quartz or glass or ceramic, or is partially transparent to visible and/or ultraviolet wavelengths or an at least partially amorphous material, and on the other hand, by at least a second material, particularly a coloured material, applied in a thin layer 40 to at least one of the lateral surfaces of balance spring 4.

In the variant visible in FIG. 3, the second phosphorescent or fluorescent material is applied in a thin layer 40 onto the four lateral surfaces of balance spring 4.

In an advantageous variant, the at least one balance spring 4 includes, on its upper 41 and lower 42 surfaces defining two parallel planes P1, P2, a surface roughness Rt of between 10 nanometres and 20 micrometres, and preferably close to one micrometre or slightly greater than this value. This slight roughness giving balance spring 4 a frosted appearance may be obtained during manufacture of a quartz balance spring 4, for example, wherein the control parameters of the method allow a more or less smooth surface finish to be obtained. The presence, at certain angles, of an overhang along transverse surfaces 46, 47 may provide a similar effect. Balance spring 4 may also be reworked in order to include micro-cells providing the required local roughness.

The addition of thin layer depositions 40 according to FIG. 3, for example, can increase or attenuate light diffusion or light guiding inside balance spring 4. The case of a fluorescent or phosphorescent layer 40 can either modify the transmission spectrum (for example if a UV light emitting diode is used as light source 5), or enable light to be stored and transmitted within the layer (by analogy with strontium aluminate SrAl2O4 doped with europium, one variety of which is known by the name of "Super-Luminova").

Such a thin layer deposition 40 can be used to colour at least one lateral surface when light is retransmitted by diffusion through at least one coil of balance spring 4.

Layer deposition can also ensure the surface roughness required for good diffusion.

The thickness of this layer 40 is preferably comprised between 10 nanometres and 1 micrometre, and preferably close to 100 nanometres.

It is possible to use layers 40 of different natures: metals, oxides, for example TiO, TiO2, Tr2O5, SiO2, Si3N4, Al2O3, or aluminium and gold based intermetallics, although this list is not exhaustive. It is also possible to coat the various lateral surfaces with layers 40 of different natures.

A layer 40 may be coloured in a particular wavelength. Interaction with light derived from source 5 produces a particular effect, especially if source 5 or relay 50 includes a monochromatic filter, or is pulsed on a single wavelength.

It is possible to structure the lateral surfaces of balance spring 4, particularly in photolithography.

The path of the light inside balance spring 4 can be modified by the presence of particular obstacles or changing light environments, for example by the presence of notches, pierced holes, chamfers or suchlike.

Structuring in masks, during the manufacture of balance spring 4, makes it possible to create specific transverse surfaces 46, 47 for two neighbouring coils of balance spring 4, particularly via the pairing of notches or of optical polarity for example, so that an inner transverse surface 46 of the outermost of the two coils cooperates in a specific manner when closest to the outer transverse surface 47 of the innermost of the two coils during the contraction of balance spring 4, and so that the optical effect produced during this greatest proximity is different from the optical effect that the two neighbouring coils exhibit together when they are at the greatest distance from each other during the elongation of balance spring 4. In particular, these two opposing transverse surfaces may receive a different monochrome treatment, for example blue on one surface, yellow on the other, these two colours being distinctly visible during elongation, whereas diffusion occurs in green in the contracted position.

In a particular embodiment, at least one of ends 6, 7 of balance spring 4 includes an end surface 43 directly receiving light from light source 5 or from a light relay 50 of said source. FIG. 4 illustrates such an embodiment, where all the coils of balance spring 4 are parallel.

In another particular embodiment visible in FIG. 5, and particularly in the case where balance spring 4 includes a twist 45 close to one of its ends 6, 7, this end includes at least one bevel 44 for receiving light in a direction D substantially perpendicular to a plane parallel to two parallel planes P1, P2, defined by the upper 41 and lower 42 surfaces of balance spring 4. Direction D is advantageously parallel to the pivot axis A of balance 2. This arrangement makes it possible to arrange a light source 5 or light relay 50 above or below balance spring 4, just above or below balance-cock 3, which may be advantageous in terms of space.

The invention makes it possible to make balance spring 4 as a light guide with controlled losses along the entire length of the balance spring.

The illumination of balance spring 4 does not necessarily occur in a preferred direction, indeed, it may occur through an upper surface 41 (plane P1 in the Figures), and/or through transverse surfaces 46, 47 of balance spring 4.

Depending on the design of light source 5 and that of balance spring 4, it is possible to obtain several types of illumination. In particular, the following will be cited:

- constant illumination, despite the motion of the balance spring;
- variable illumination, according to the motion of the balance spring, for example to simulate the beating of a human heart: it is possible to illuminate the balance spring throughout its length when the coils are close to each other, and to reduce the illumination to a minimum (extinction effect) when the coils are remote from each other; or vice versa. Losses are therefore controlled in accordance with the position of the coils;
- coloured illumination, with different colours at the two ends of the balance spring, which can be obtained with a balance spring 4 coated with ad hoc thin layers 40.

The coupling between light source 5, or relay 50, and balance spring 4, may result from their proximity: source 5 or relay 50 transmits light with a sufficient energy level for balance spring 4 to capture the light, before retransmitting it through diffusion.

The coupling may also advantageously and preferably be achieved by direct surface-to-surface contact, or by a plug-in arrangement, or by any known light guide and optical fibre technology.

Preferably, the light is concentrated upstream of its transmission to the balance spring, or when it enters balance spring 4. In a particular and advantageous embodiment, the concentrator is integrated in balance spring 4 during manufacture.

The distribution of stresses in balance spring 4 varies during the contraction or elongation of the balance spring for a given setting. It also varies when there is a change in the characteristics of the regulating member, and in particular with the oscillation amplitude of balance 2. A variation in the illumination of balance spring 4 can, therefore, reveal an amplitude modification.

Balance spring 4 according to the invention may be inhomogeneous, which thus makes it possible to create particular technical functions, and distinct light diffusion areas.

To "make amorphous" means here changing structure so as to modify the refractive index. A coil can be made amorphous locally, particularly by means of a laser treatment. Balance spring 4 can also be made entirely amorphous.

Balance spring 4 may be at least locally polished. Particular mechanical structuring makes it possible to create light leakage surfaces selected with specific orientations on certain surfaces and at specific locations.

The difficulties in guiding and diffusing light throughout the length of a balance spring 4, which may have a large extended length, may result in neutralization of some coils, or some coil portions, preventing light from escaping therefrom, for example by means of reflective layers or similar functional masks. This therefore makes it possible to save light and guide light to the ends 6 and 7 of balance spring 4.

Light source 5 may take various forms. Preferably, source 5 is a light emitting diode or a phosphorescent or fluorescent component.

Advantageously, source 5 is phosphorescent and/or fluorescent, preferably phosphorescent because of the longer afterglow duration, which may be up to several hours, and is compatible with the possibility of illuminating the balance spring at any time throughout the duration of one night.

The light source will be termed "phosphorescent" in the description below for the sake of simplicity. Such a phosphorescent source advantageously comprises rare earth aluminates, well known to physicists, for example strontium aluminate $SrAl_2O_4$ doped with europium, one variety of which is known as "Super-LumiNova", or rare earth silicates, or a mixture of rare earth aluminates and silicates. Other commercial materials such as "Lumibrite" are also suitable. Materials like tritium (3H), promethium-147, or radium-226 have excellent phosphorescent properties, but their high beta and/or gamma radioactivity greatly limits their use, and they can only be used in trace amounts, preferably in combination with rare earth aluminates, for some very specific military or astronautic applications, use at great depths, or similar, and with protection which considerably increases the volume of the timepiece; the terms "radioluminescence" or "autoluminescence" are employed where these materials are used. There are also known borosilicate glass capsules containing gases, known as"GTLS" (gaseous tritium light sources) produced by MB Microtech, containing tritium (3H), and which, like radium, do not require any external excitation to emit light, such capsules are used in particular for illuminating mainly military watch hands or appliques.

The excitation light originates from the user's environment, solar light, ambient light. The light source is housed inside the inner volume of the case of the timepiece or of the watch. The ambient energy can be collected in a partially or totally transparent, or translucent case middle and/or in a partially or totally transparent or translucent dial and/or in a display aperture, particularly for a date or suchlike. Ambient energy may also be collected by an accessory adjoining the timepiece, such as a watch bracelet or strap, and be transmitted by a wave guide or fibre optic or suchlike. Similarly, ambient energy may be captured in other external parts such as the back cover, bezel, flange or other parts.

The invention further includes a mechanical timepiece movement 10 including at least one regulating member 1, wherein the light source 5 is either situated in the regulating member 1 as described above, or is moved out of regulating member 1 and into movement 10, in which case it is connected by at least one light guide 51 or an optical fibre to a light relay 50 which is situated in regulating member 1 in proximity to balance spring 4.

More particularly, this mechanical timepiece movement 10 includes at least one watch or timepiece regulating member 1 including a balance 2, a balance-cock 3, and at least one balance spring 4 attached between balance 2 and balance-cock 3. This at least one balance spring 4 transmits and diffuses the light emitted by at least one light energy source 5 which is moved out of regulating member 1 and into movement 10 to which it is connected by at least one light guide 51 or an optical fibre to a light relay 50 which is situated in regulating member 1 in proximity to the balance spring 4.

The invention further concerns a timepiece 100 including one such mechanical movement, and/or at least one regulating member 1 with an integrated light energy source. Light source 5 is either situated in regulating member 1, or is moved out of regulating member 1 and into movement 10 in which case it is connected by at least one light guide 51 or an optical fibre to a light relay 50 which is situated in regulating member 1 in proximity to balance spring 4, or is moved out of movement 10 and into timepiece 100 in which case it is connected by at least one light guide 51 or an optical fibre to a light relay 50 which is situated in regulating member 1 in proximity to balance spring 4.

Preferably, this timepiece 100 is a watch, and balance spring 4 is of the "flat" type described above.

In a variant not illustrated in the Figures, the invention may be coupled to a stroboscopic device inserted on the light trajectory between the light source and the balance spring, so as to achieve particular lighting effects.

Stroboscopic structuring, according to the frequency and wavelength of the light diffused by source 5 or relay 50, makes it possible to produce an anti-counterfeiting mark or a secret signature, by structuring or masking, and which is only revealed under certain lighting conditions.

The slowing of light, due to a variation in refractive index which is linked to a variation in internal stresses during the contraction or elongation of the balance spring, also makes specific authentication possible.

Diffusion by a balance spring 4, treated and coloured in a first wavelength, of a pulsed monochrome light in another wavelength, provides a particular visual display.

A variant of the invention, more applicable to clocks and static timepieces, consists in application to a spring of a regulating member, which is not a substantially flat balance spring as above, but which is a helical spring.

In short, the device for the visual display of the balance spring offered by the invention is compact, and low energy consuming. It draws the user's gaze to the visible heart of his watch or timepiece, and highlights the particularly living nature of a mechanical timepiece.

It is also possible to apply the various aforecited propositions for a balance spring made of the same material having other functions than that of a regulating member.

The invention claimed is:

1. A watch or timepiece regulating member comprising:

a balance, a balance-cock, at least one light energy source, and at least one balance spring attached between said balance and said balance-cock, said at least one balance spring being arranged to transmit and diffuse light, wherein said at least one balance spring transmits and diffuses the light emitted by said at least one light energy source.

2. A timepiece comprising:

a mechanical movement including at least one regulating member according to claim 1.

3. The regulating member according to claim 1, wherein said at least one balance spring is made of quartz or of glass or of ceramic, or is partially transparent to visible and/or ultraviolet wavelengths or made of an at least partially amorphous material.

4. The regulating member according to claim 1, wherein said balance-cock carries said light energy source in proximity to an outer end of said balance spring.

5. The regulating member according to claim 1, wherein said balance carries said light energy source in proximity to an inner end of said balance spring.

6. The regulating member according to claim 1, wherein said at least one balance spring diffuses light on at least one portion of the cross-section thereof.

7. The regulating member according to claim 1, wherein said at least one balance spring diffuses light over the entire length thereof between said balance-cock and said balance.

8. The regulating member according to claim 1, wherein said at least one balance spring is of rectangular cross-section and is formed of a single material.

9. The regulating member according to claim 1, wherein said at least one balance spring is of rectangular cross-section and is formed by a first material which is quartz or glass or a ceramic, or a material partially transparent to visible and/or ultraviolet wavelengths or an at least partially amorphous material, and by at least one phosphorescent or fluorescent dopant, said dopant being incorporated in the mass of said first material.

10. The regulating member according to claim 1, wherein said at least one balance spring is of rectangular cross-section and is formed by a first material which is quartz or glass or a ceramic, or a material partially transparent to visible and/or ultraviolet wavelengths or an at least partially amorphous material, and by at least a second phosphorescent or fluorescent material applied in a thin layer to at least one of the lateral surfaces of said balance spring.

11. The regulating member according to claim 10, wherein said second phosphorescent or fluorescent material is applied in a thin layer to the four lateral surfaces of said balance spring.

12. The regulating member according to claim 1, wherein said at least one balance spring is of rectangular cross-section and is formed by a first material which is quartz or glass or a ceramic, or a material partially transparent to visible and/or ultraviolet wavelengths, or an at least partially amorphous material, and by at least a second colored material applied in a thin layer to at least one of the lateral surfaces of said balance spring.

13. The regulating member according to claim 1, wherein said at least one balance spring includes, on the upper and lower surfaces thereof defining two parallel planes, a surface roughness Rt of between 10 nanometres and 20 micrometres.

14. The regulating member according to claim 1, wherein at least one of the ends of said balance spring includes an end surface directly receiving light from said light source or from a light relay of said light source.

15. The regulating member according to claim 14, wherein said end includes at least one bevel for receiving light in a substantially perpendicular direction to a plane parallel to two parallel planes defined by the upper and lower surfaces of said balance spring.

16. The regulating member according to claim 1, wherein said light source is a light emitting diode or a phosphorescent or fluorescent component.

17. A mechanical timepiece movement, comprising:

at least one watch or timepiece regulating member including a balance, a balance-cock, and at least one balance spring attached between said balance and said balance-cock, wherein said at least one balance spring transmits and diffuses the light emitted by said at least one light energy source which is shifted out of said regulating member and inside said movement to which it is connected by at least one light guide or an optical fiber to a light relay which is situated in said regulating member in proximity to said balance spring.

18. A timepiece comprising:

a mechanical movement according to claim 17.

* * * * *